United States Patent [19]

Comeau

[11] 4,301,852

[45] Nov. 24, 1981

[54] HEAVY DUTY TRAVERSE ROD AND CURTAIN SUPPORT COMBINATION

[75] Inventor: Paul E. Comeau, Warwick, R.I.

[73] Assignee: Kenney Manufacturing Company, Warwick, R.I.

[21] Appl. No.: 45,123

[22] Filed: Jun. 4, 1979

Related U.S. Application Data

[63] Continuation-in-part of Ser. No. 23,071, Mar. 23, 1979.

[51] Int. Cl.[3] ..... A47H 5/032

[52] U.S. Cl. ..... 160/345; 16/87.6 R; 160/126

[58] Field of Search ..... 160/123–126, 160/330, 345–348; 16/87.6 R

[56] References Cited

U.S. PATENT DOCUMENTS

| | | | |
|---|---|---|---|
| Re. 26,269 | 9/1967 | Ford | 160/346 |
| 1,904,588 | 4/1933 | Weinberg | 160/345 |
| 3,199,142 | 8/1965 | Salzmann et al. | 160/345 |
| 3,430,678 | 3/1969 | Steck et al. | 16/87.6 R |
| 3,693,696 | 9/1972 | Salzmann | 160/345 |
| 3,951,197 | 4/1976 | Cohen et al. | 16/87.6 R |

*Primary Examiner*—Philip C. Kannan

[57] ABSTRACT

A two-part, telescoping curtain traverse rod is provided having an inverted U-shaped cross-section defining a slot in the underneath surface of the rod having two upstanding tracks therein. Idler curtain carriers are movable on rollers on the forward of the two tracks. Master curtain carriers are movable on rollers on the forward track and also have an extended body portion which is slidable on the rearward track. The rearward track further serves to confine a draw cord within the rod. The idler carriers are free to slide in overlapping relation with the extended body portions of the master carriers so that the spacing between curtain support points of both master and idler carriers can be made equidistant. The master carriers are further provided with means for securing the ends of the draw cord so as to fix the master carriers in the correct position within the rod for any degree of extension of the telescoping portions of the rod.

1 Claim, 6 Drawing Figures

HEAVY DUTY TRAVERSE ROD AND CURTAIN SUPPORT COMBINATION

FIELD OF THE INVENTION

The present invention is a continuation in part of application Ser. No. 023,071 filed Mar. 23, 1979, entitled "Curtain Supporting and Positioning Combination", and also a continuation in part of two other applications recently filed entitled respectively "Drapery and Support Combination" and "Traverse Rod and Support Combination" (serial numbers to be supplied).

The present invention relates to drapery supports and more specifically to telescoping curtain rods and curtain carrier combinations adapted for supporting heavy curtains. In one particular the invention relates to a heavy duty, telescoping traverse rod having a draw cord, the ends of which are secured to master carriers located principally within the rod leaving only a continuous loop of the cord extending outside of the rod for pulling the curtain opened or closed. In another particular the invention relates to a master carrier and rod combination adapted to provide the master carrier with longitudinal stability but also to permit equal spacing of all curtain support points in both the open and closed positions of the curtain. The invention is particularly useful for the support of heavy drapes of a type known as "woven wood" in which the curtain comprises a multiplicity of hinged, vertically disposed slats adapted to open and close in accordion fashion. The invention, however, is also useful for the support of other types of curtains.

BACKGROUND OF THE INVENTION

In the design of traverse rods for the support of especially heavy curtains a number of problems arise. For example, the usual C-shaped cross-sectioned telescoping rod although satisfactory for light curtains, is not well suited for the support of heavy curtains due to the eccentric application of the weight of the curtain to the lower lip of the C at the rear face of the rod. This introduces undesireable torsion in the rod between the supports. A preferred cross-section for heavy duty rods, therefore, comprises an inverted U-shape having a slot in its lower face defining one or two tracks on which the curtain carriers ride. In this way the weight of the curtain can be applied more nearly along the centerline of the rod and torsion is minimized. The inverted U-shape, however, has other disadvantages. Thus, with the C-shape, the draw cord remains within the lower semi-circle of the C and has no tendency to come out of the slot in the back of the rod, whereas, with an inverted U-shape, the cord tends to drop out of the slot and otherwise to interfere with the action of the carriers. In addition, with the C-shape it is relatively easy to lead a bight of the draw cord out of the rod to the rear of the master carriers, so that, simply by looping the bight over an exposed hook or cleat on the rear face of the master carrier the position of the master carrier, along the rod, can be adjusted and fixed. However, with the inverted U-shaped cross-section a bight of cord extending below the rod would be undesireable and unsightly.

Still another problem has to do with the spacial relationship between the support points for the curtain. Usually, master carriers are elongated and slide on two contact points spaced longitudinally of the rod. The reason for the longitudinal spacing of the support points for the master carriers is that, in order to avoid jamming, the master carrier needs to be supported against longitudinal tipping while it is being pulled along the rod by the draw cord. In addition, in many designs the master carrier is provided with an extension arm in order to support the curtain edges in overlapping relation, and the master carrier needs to be elongated in order to support the extension arm. The elongation of the master carrier, however, makes it impossible for the support points of the idler carrier to be moved to a position adjacent to the support points of the masters. This prevents the portion of the curtain which is supported by the master carrier from coming together when the curtain is pulled to the fully opened position, and leaves an unpleated portion at the edge of the curtain. The effect is particularly noticeable with woven wood type curtains which come together in accordian fashion. If the slats cannot come together with all support points equally spaced, the symmetry of appearance is lost.

Other problems associated with supporting heavy weight curtains have to do with improving the ease of longitudinal motion of the carriers on the tracks of the rod and a reduction of interference between the carriers and the ends of the telescoping rod sections within the rod.

The general object of the present invention, therefore, is to provide a curtain rod and support combination adapted to support heavy weight curtains for free rolling, virtually friction-free action within the rod. Still another object is to provide a telescoping rod and support combination equipped both for free rolling action and for transition of the curtain supporting elements from one telescoping section to another without interference from the ends of either section. Another object is to provide a master carrier for such a combination which extends longitudinally within the rod, but which at the same time permits the idler carriers to overlap the master so that, when the curtain is fully opened the support points for the curtain may be equally spaced at the side of the window frame. Still another object is to provide a master carrier and draw cord arrangement for a telescoping rod having an inverted U-shaped cross-section, which cord and master carrier arrangement permits the cord to remain within the rod without risk of dropping out of the opening in the bottom of the rod and which also permits proper positioning of the master relative to the rod for any selected rod length followed by fixing the master carrier in that position without a visible protrusion of a bight of cord below the rod.

BRIEF DESCRIPTION OF THE INVENTION

These and other objects of the invention are accomplished in an illustrative embodiment by employing an inverted U-shaped tubular rod having a slot in its underneath surface which defines a pair of parallel, upstanding tracks within the rod. Between the rearward of these two tracks and the rear face of the rod there is a longitudinally extending cavity in which the draw cord lies. Master and idler curtain carriers, equipped with rollers, roll on the forward of the two tracks. The carriers are designed with support points for the curtains lying directly below the forward track. Thus, the weight of the curtains does not tend to tip the carriers forward. The rollers on which the carriers ride, have a wide bottomed groove which is wide enough to accommodate more than two thicknesses of the rod wall material. In this way, the carriers ride from one section to the other of telescoping rod sections without interference within the rod from the end of either rod section. The master carriers are each provided with one roller only riding on the forward track, but they also have a longitudinally extending body portion which engages the rearward track in sliding relation. As noted, the weight of the curtain does not tend to tip the carriers, and, therefore, friction from the sliding action of the longitudinally extending body portions of the master carriers on the rearward track is not increased by increased curtain weight. The body portions of the master carriers, however, provide sufficient length for a draw cord to pull them along the rod without harmful tilting or jamming. On the other hand, the body portions of the master carriers are confined to the rearward part of the slot in the underneath surface of the rod such that the idler carriers are free to pass alongside the masters in overlapping relation within the slot. In this way an elongated master may be employed and yet the support points for the curtain can be equispaced at the sides of the window when the curtain is fully opened. In cases where the master carrier is provided with a protruding arm for overlapping the curtain edges in the middle of the window when the curtain is closed, the idlers can at least travel to a point adjacent to the base of that arm.

The foregoing features are of particular significance in the support of woven wood type curtains, but many of them also have a more general application as well.

BRIEF DESCRIPTION OF THE DRAWINGS

The illustrative embodiment described herein is shown in the accompanying drawings in which.

DETAILED DESCRIPTION OF THE INVENTION

Figure 1:
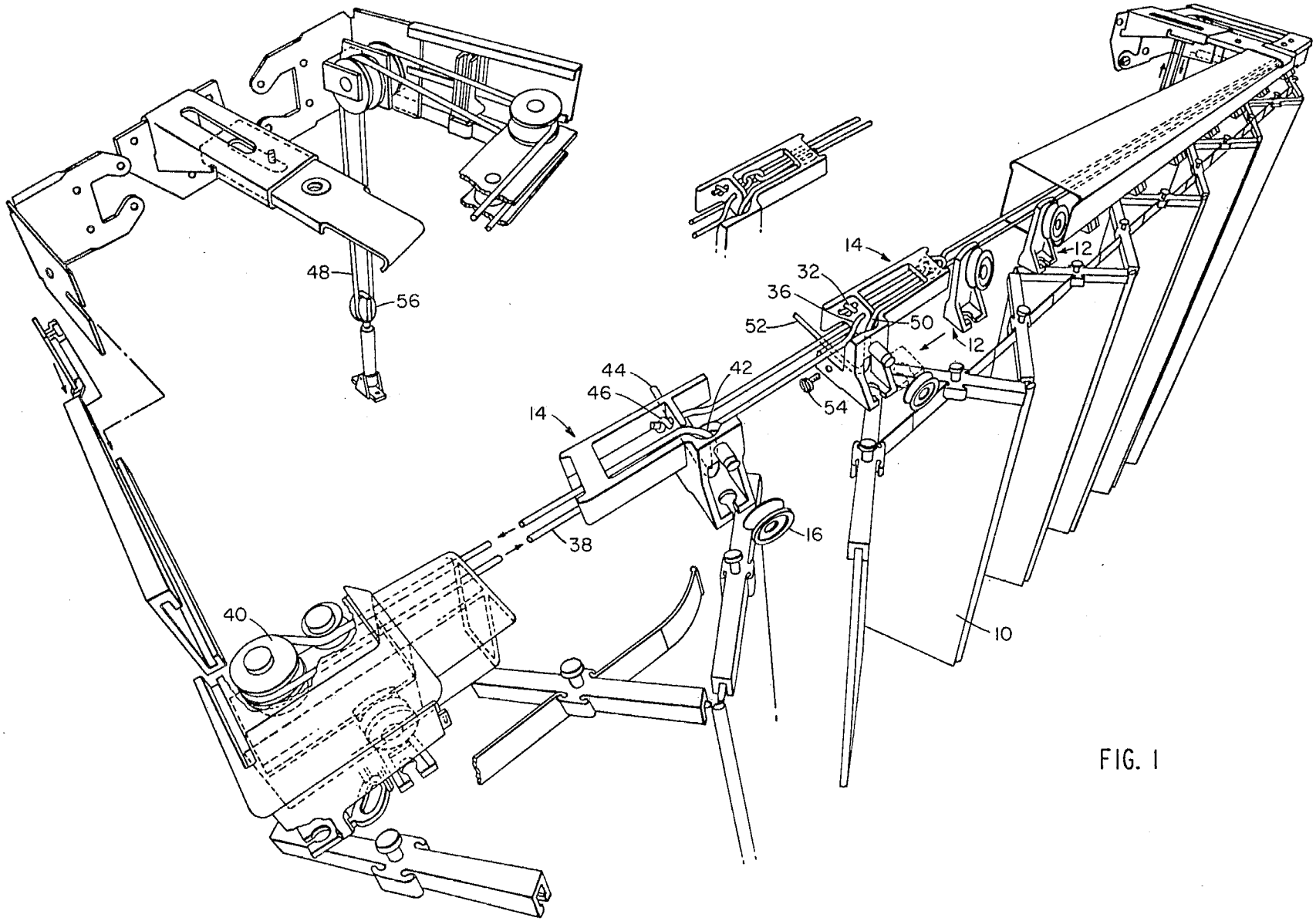
FIG. 1 is an exploded view in perspective showing the combination of the invention in the context of supporting a woven wood type curtain.
Figure 2:
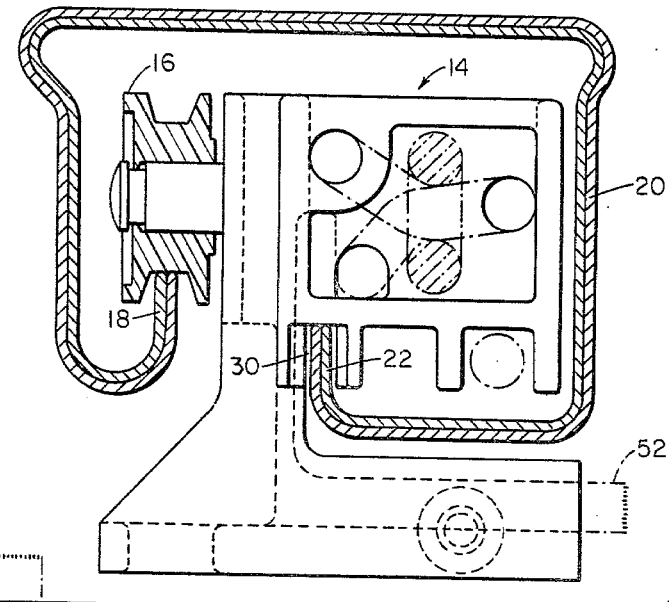
FIG. 2 is a view in cross-section of a telescoping curtain rod according to the invention showing a master carrier in place within the rod.
Figure 3:
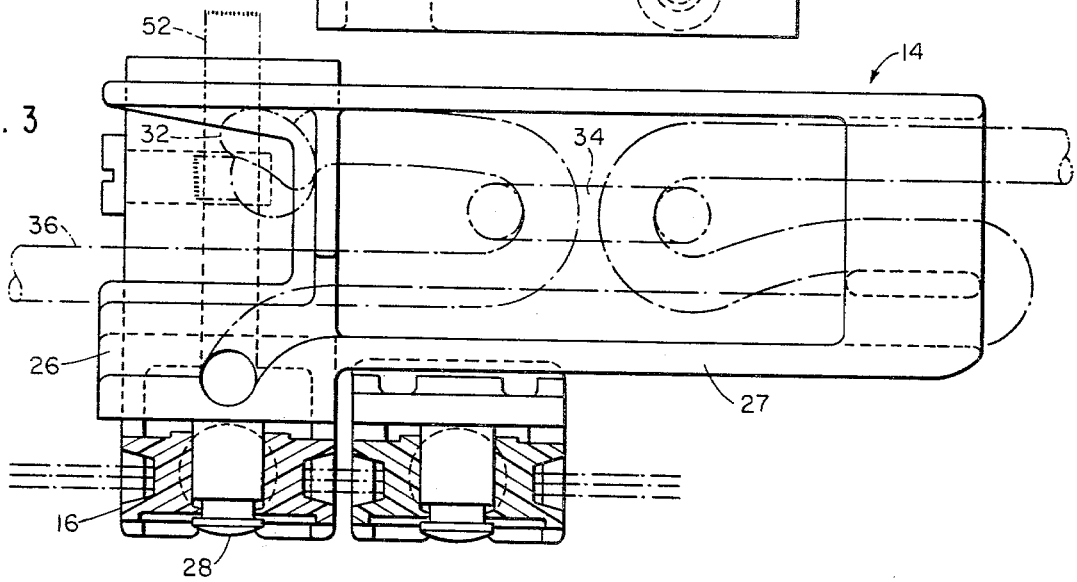
FIG. 3 is a plan view from above of a right hand master carrier and an idler carrier showing how the idler carrier overlaps the master within the rod.
Figure 4:
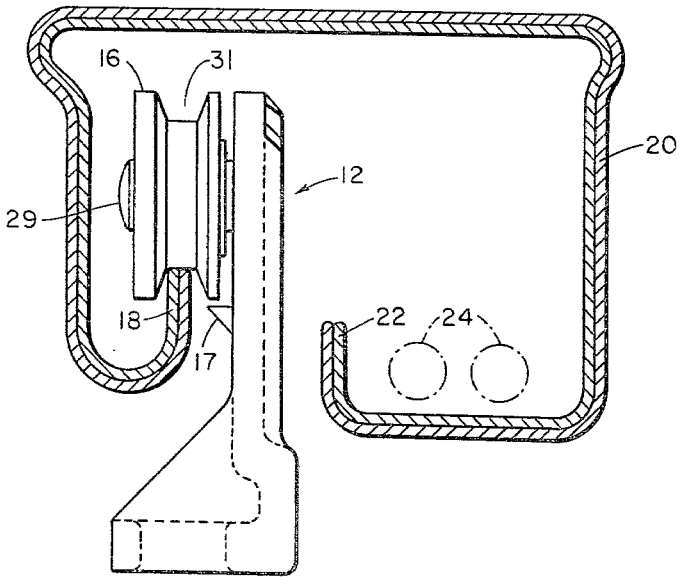
FIG. 4 is a cross-sectional view of a telescoping rod according to the invention showing an idler carrier in place within the rod.
Figure 5:
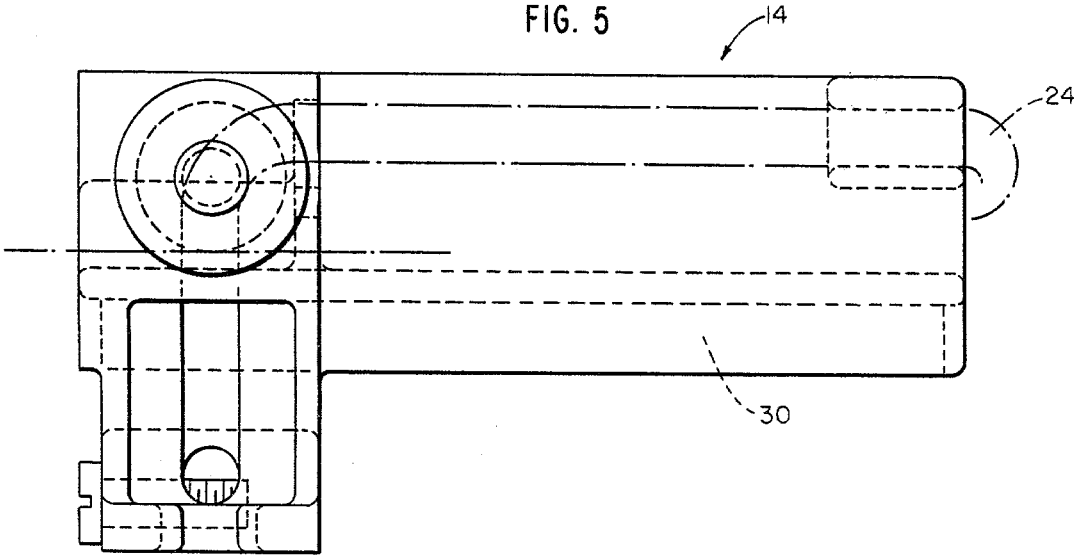
FIG. 5 is a view in front elevation of a right hand master carrier according to the invention.
Figure 6:
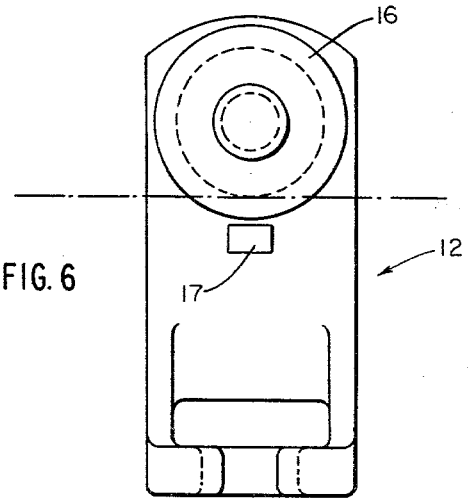
FIG. 6 is a view in front elevation of an idler according to the invention.

The illustrative embodiment of the invention herein described is shown in the context of supporting a woven wood curtain 10 comprising vertically disposed, hinged slats arranged to open and close in accordion fashion. The curtain slats are supported by idler carriers indicated at 12 and master carriers indicated at 14 which are adapted to ride on rollers 16, rolling on a forward upstanding track 18 within an inverted U-shaped telescoping curtain rod 20. The master carriers 14 are provided in a right and left hand form. In FIGS. 2, 3 and 5 a right hand master is shown. The left hand master is simply a mirror image of the right hand master and both forms are shown in perspective in their respective positions in FIG. 1.

Rod 20 also has a rearward upstanding track 22 within it, which track defines an elongated cavity between itself and the rearward wall of rod 20 and serves to guide a draw cord 24 to keep it from escaping out of the slot in the rod defined between tracks 18 and 22.

Master carriers 14 comprise a base portion 26 and a longitudinally extending body portion 27. The base portion 26 is provided with a forwardly extending hub 28 adapted to receive roller 16. Forwardly extending hubs 29 on idler carriers 12 are adapted to receive the rollers 16 which support the idlers. A small projection 17 below roller 16 prevents forward track 18 from entering between roller 16 and the body of idler 12. Longitudinally extending body portions 27 of the master carriers may be provided with lost-motion mechanism for cord 24 as described in co-pending application Ser. No. 023,071. In addition, longitudinally extending body portions 27 are provided with a groove 30 in their underneath surface to receive rearward track 22 and support master carriers 14 thereon in sliding relation. In this way, master carriers 14 are supported longitudinally within the rod. With reference to FIG. 3, however, it will be seen that the forward face of longitudinally extending body portion 27 terminates near enough to rearward track 22 to permit idler carriers 12 to move along forward track 18 in overlapping relation with body portion 27 and up to roller 16 of the master carrier. By this arrangement, the spacing between the support points for the curtain, whether they be provided by master or idler carriers can be the same, and yet the master carrier is still supported in an extended longitudinal manner within the rod.

Rollers 16 are provided with a flat based groove 31 which is wide enough to receive both thicknesses of the metal of the two sections of telescoping traverse rod 20 with ample room to spare. In this way interference between the ends of the sections and the carriers is avoided and the longitudinal alignment of the master carriers 14 is maintained by groove 30 rather than by roller 16.

The support points for the curtain 10 on both the master carriers 14 and the idler carriers 12 are directly below forward track 18 such that the weight of the curtain does not tend to tip the carriers. Likewise the weight of the curtain is applied within the rod whereby twisting of the rod due to the weight of the curtain is reduced.

Draw cord 24 comprises two loops one of which is secured to right hand master carrier 14 at 32, passes around "lost motion" ring at 34, out of the right hand master carrier 14 at 36, under left hand master carrier 14 at 38, around a pulley assembly 40 at the left end of the rod, back to left hand master carrier 14, through a hole 42 in left hand master carrier 14, down and out the rear face of left hand master carrier 14 at 44. The second loop of draw cord 24 starts with a connection to left hand master carrier 14 at 46 from which the cord proceeds under right hand master carrier 14 to the right hand end of the rod where it is fed over pulleys to provide an exterior loop 48 (see FIG. 1) by which the curtain is drawn open and closed. The cord then returns over the pulleys into the rod and back to right hand master carrier 14 where it passes through the ring at 34 and downwardly through hole 50, and out to the rear of right hand master carrier 14 at 52. A set screw 54 is used at each master carrier 14 to anchor the cord 24 at the respective exit points 44 and 52.

When the rod is installed, the cord 24 remains free in master carriers 14 while loop 48 is inserted in spring-loaded snatch pulley 56 and the master carriers are placed in the correct closed position. The exposed ends of cord 24 are then drawn until all slack is removed, and the correct tension on spring-loaded snatch pulley 56 has been attained. At this point set screws 54 are tightened, and the operation of the curtain is tested to make sure that the cord positioning is correct. If it is, the exposed ends of cord 24 are cut off flush with the rear face of master carriers 14.

Since various modifications of the illustrative embodiment herein shown will now be apparent to those skilled in the art it is not intended to confine the invention to the precise form herein shown but rather to limit it only in terms of the appended claims.

I claim:

1. A traverse rod for supporting curtains comprising:

an elongated hollow rod having an elongated slot longitudinally thereof, a pair of master carriers movable in said slot for supporting a curtain, a draw cord assembly comprising first and second loops, each of which has first and second free ends, one loop of which extends outwardly of said rod to serve as a means for drawing the curtain open and closed, means for securing the first free end of said first loop to a first master carrier of said pair, means for securing the first free end of said second loop to a second master carrier of said pair, pulley means at one end of said rod for receiving said first loop and doubling it back within said rod but with a portion of said first loop extending outwardly of said rod, pulley means at the other end of said rod for receiving said second loop and doubling it back within said rod, means on said second carrier for adjustably securing the free second end of said first loop to said second carrier, and means on said first carrier for adjustably securing the free second end of said second loop to said first carrier, whereby the longitudinal position of said master carriers is determined by adjustment of the second ends of said loop.

* * * * *